United States Patent [19]

Mongeon

[11] 4,174,518

[45] Nov. 13, 1979

[54] INTRUSION WARNING SYSTEM

[75] Inventor: Ronald W. Mongeon, San Jose, Calif.

[73] Assignee: Stellar Systems, Inc., Santa Clara, Calif.

[21] Appl. No.: 820,014

[22] Filed: Jul. 28, 1977

[51] Int. Cl.[2] ..... G08B 13/24

[52] U.S. Cl. ..... 340/561; 323/17; 325/186; 340/564

[58] Field of Search ..... 340/258 R, 258 B, 258 C, 340/561, 564; 325/151, 185, 186; 331/185, 186; 330/129, 130, 131, 135; 323/17, DIG. 1

[56] References Cited

U.S. PATENT DOCUMENTS

| | | | |
|---|---|---|---|
| 2,956,269 | 10/1960 | Schmidt | 340/258 C |
| 3,047,849 | 7/1962 | Hansen | 340/258 C |
| 3,237,105 | 2/1966 | Kalmus | 340/258 C |
| 3,644,832 | 2/1972 | Sherman, Jr. | 325/186 |
| 3,778,807 | 12/1973 | Ralston | 340/258 C |
| 3,790,878 | 2/1974 | Brokaw | 323/17 |
| 4,064,499 | 12/1977 | Geiszler et al. | 340/258 C |

*Primary Examiner*—John W. Caldwell, Sr.
*Assistant Examiner*—Joseph E. Nowicki
*Attorney, Agent, or Firm*—Spencer & Kaye

[57] ABSTRACT

A quasi-stationary electric field is produced by means of an oscillator which produces an output frequency in the range of from 1–40 KHz and whose output is connected via a field voltage amplifier to a field wire which is mounted on and suspended between a plurality of fence posts by means of insulators and extends along at least a portion of the perimeter of an area to be protected. The electric field is detected by an antenna or wire whose output is connected to an AM detector via an amplifier. The output of the AM detector is connected to a high gain voltage amplifying and filtering arrangement so that at the output of this high gain amplifier only signals within the relatively low frequency range of from 0.2 to 2HZ associated with movement of an intruder are present. The output signal from the high gain amplifier is fed to a threshold circuit which produces an output signal whenever the input signal thereto exceeds a predetermined threshold value, and this output signal is fed to an alarm producing circuit. The output voltage of the field voltage amplifier is regulated to prevent changes of same due to environment caused changes in the impedance of the field wire from resulting in a false alarm.

7 Claims, 5 Drawing Figures

FIG. 3
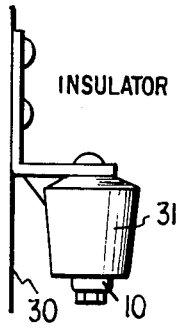
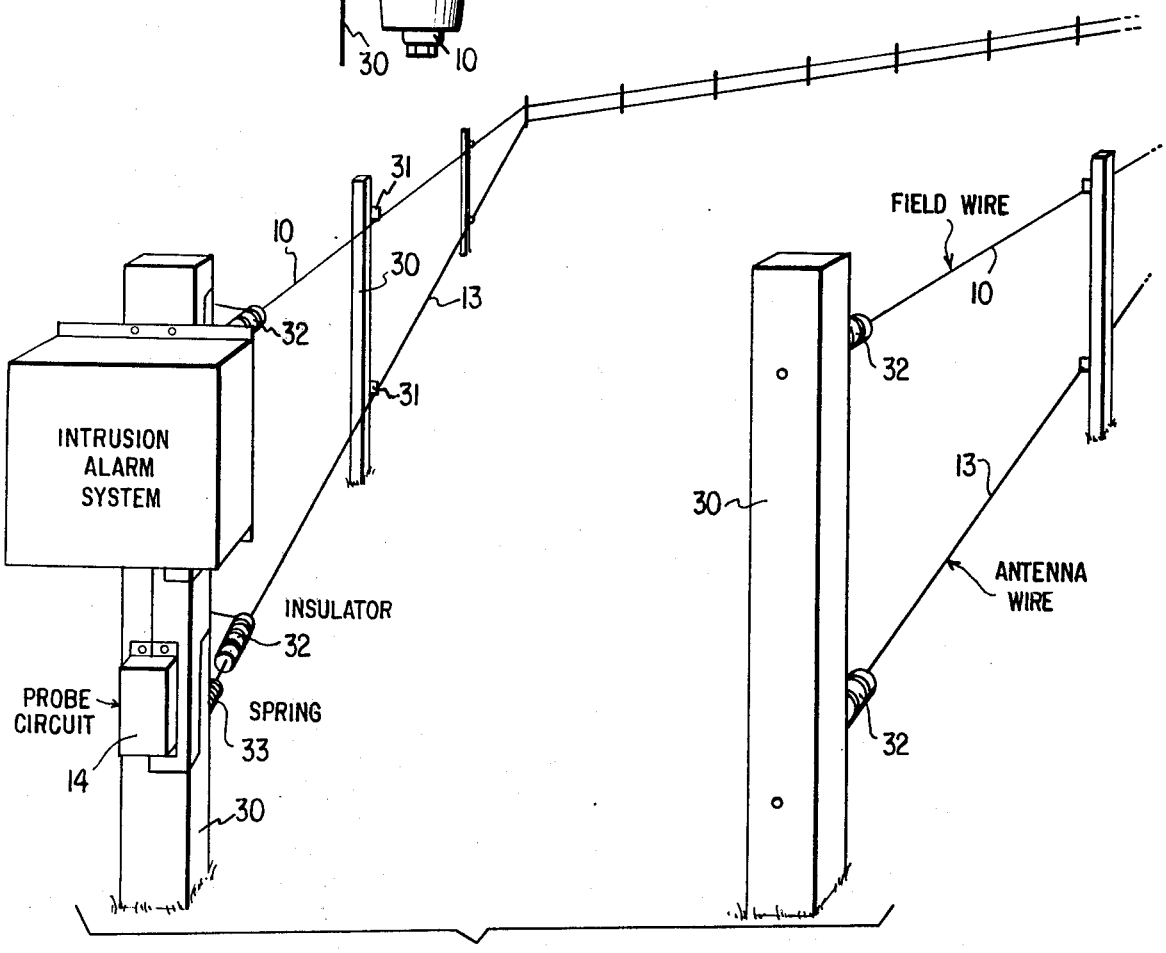
FIG. 2
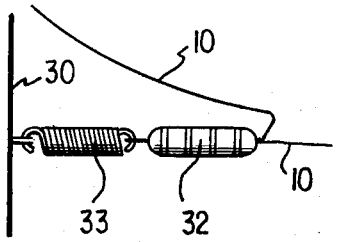
FIG. 4

INTRUSION WARNING SYSTEM

CROSS-REFERENCE TO RELATED APPLICATION

This application is related to the commonly assigned co-pending U.S. application Ser. No. 612,918, filed Sept. 12th, 1975, by Theodor D. Geiszler and Ronald W. Mongeon, for AN INTRUSION WARNING SYSTEM UTILIZING AN ELECTRIC FIELD now U.S. Pat. No. 4,064,499, issued Dec. 20th, 1977.

BACKGROUND OF THE INVENTION

The present invention relates to an improved intrusion warning system of the type wherein the presence of an intruder within a given area is detected by determining the changes in the level of a quasi-stationary electric field caused by the movement of an intruder within the electric field. More particularly, the present invention relates to an improvement of the intrusion warning system disclosed in the above-identified U.S. patent application Ser. No. 612,918, the subject matter of which is incorporated herein in its entirety by reference.

According to the system disclosed in the above-identified application, a quasi-stationary electric field is produced by means of a field wire which is insulated from ground and which is connected by a voltage amplifier to the output of a frequency controlled oscillator which produces an output signal having a wavelength which is very long compared to the length of the field wire and a frequency which is in the range of from 1 to 40 KHz. The electric field is detected by means of an electrode or a receiving antenna which is disposed within the electric field and which is connected by an amplifier to an AM detector. The output signal from the detector is fed to a high gain voltage amplifier and filtering arrangement which provides output signals only within the relatively low frequency range of 0.2 to 2 Hz associated with movement of an intruder. The output signal from this amplifying and filtering arrangement is then fed to a threshold circuit which produces an output signal whenever the input signal thereto exceeds a predetermined threshold value for a predetermined period of time, and this output signal is then fed to an alarm producing circuit. Thus, n alarm is only produced if the sensed change in the electric field amplitude exceeds a predetermined or preset level, the rate of change is between 0.2 Hz and 2.0 Hz, and the electric field change persists for a predetermined or preset length of time.

As is further disclosed in the above identified application, the intrusion warning system may be utilized to provide protection for the perimeter, or at least a portion of the perimeter, of a given area. In such case, the field wire comprises a length of wire which extends along the portion of the perimeter to be protected and is mounted on and suspended between a plurality of fence posts distributed about the perimeter by means of respective insulators. The receiving antenna, in this case, likewise comprises a length of wire which is similarly mounted on the fence posts and extends along the perimeter of the area to be protected substantially parallel to the field wire. In such systems, the length of the field wire may be up to approximately 1000 feet. With such perimeter type insulations, it has been found that under certain environmental conditions, the system may produce alarms in the absence of any movement by an intruder in the produced electric field, i.e., false alarms.

In particular, these false alarms tend to occur in outdoor perimeter type systems, wich have been installed for a period of time, upon the onset of high moisture conditions, for example, the beginning of a rain storm. It has been discovered that these false alarms are caused by resistive paths to ground formed by dirt and/or moisture on the insulators which connect the field wire to the fence posts. These resistive paths effectively reduce the impedance of the field wire as seen by the field voltage amplifier, causing its output voltage to change. This change in the field voltage, and hence in the level of the quasi-stationary electric field, is detected by the fence wire and processed as an alarm.

SUMMARY OF THE INVENTION

It is therefore the primary object of the present invention to provide an improved intrusion warning system of the above-identified type wherein the susceptibility to false alarms due to changes in the effective impedance of the field wire is materially reduced.

The above object is achieved according to the present invention in that in an intrusion warning system for indicating the intrusion of an object into a given area comprising means for producing a quasi-stationary electric field along at least a portion of the perimeter of the given area including a long field wire extending along a portion of the perimeter of the given area with the field wire being mounted on and extending between a plurality of fence posts by means of respective insulators so that the field wire is insulated from ground and first circuit means connected to said field wire for producing an output signal having a wavelength which is very long compared to the length of said field wire and a frequency which is in the range of from 1–40 KHz; a receiving antenna within said area for receiving said electric field, an amplifier connected to the output of said antenna, an AM detector connected to said antenna via an amplifier for detecting changes in the received and amplified electric field signals, second circuit means for amplifying the output signal from said detector and for filtering same to pass only the low frequency component of the detected signal in the range from approximately 0.2 to 2 Hz due to a disturbance of said electric field caused by movement of an intruder, a threshold circuit arrangement connected to the output of said second circuit means for producing an output signal whenever the input signal thereto exceeds a predetermined threshold value and means responsive to said output signal from said threshold circuit arrangement, for providing an alarm indicating the disturbance of said electric field by an intruder; the first circuit means, which includes an oscillator circuit for producing an output signal having said frequency in the range of from 1–40 KHz, and an amplifier having its input connected to the output of the oscillator and its output connected to the field wire, further includes voltage regulating means for regulating the output voltage from the amplifier.

The voltage regulating means regulates the output voltage from the amplifier sufficiently to prevent changes in the amplifier output voltage which are sufficient to cause the signal processing circuitry connected to the receiving antenna or wire from responding. Preferably the voltage regulating arrangement is a closed loop arrangement wherein the voltage regulator corrects any change in the output voltage from the amplifier by varying the supply voltage to the output stage of the amplifier.

BRIEF DESCRIPTION OF THE DRAWINGS

FIG. 2 shows the field wire and the sense wire or receiving antenna mounted on a plurality of fence posts for providing perimeter protection.

FIGS. 3 and 4 show different arrangements of the insulators for connecting the field wire and/or the antenna or sense wire to the fence posts.

DETAILED DESCRIPTION OF THE PREFERRED EMBODIMENTS

Figure 1:
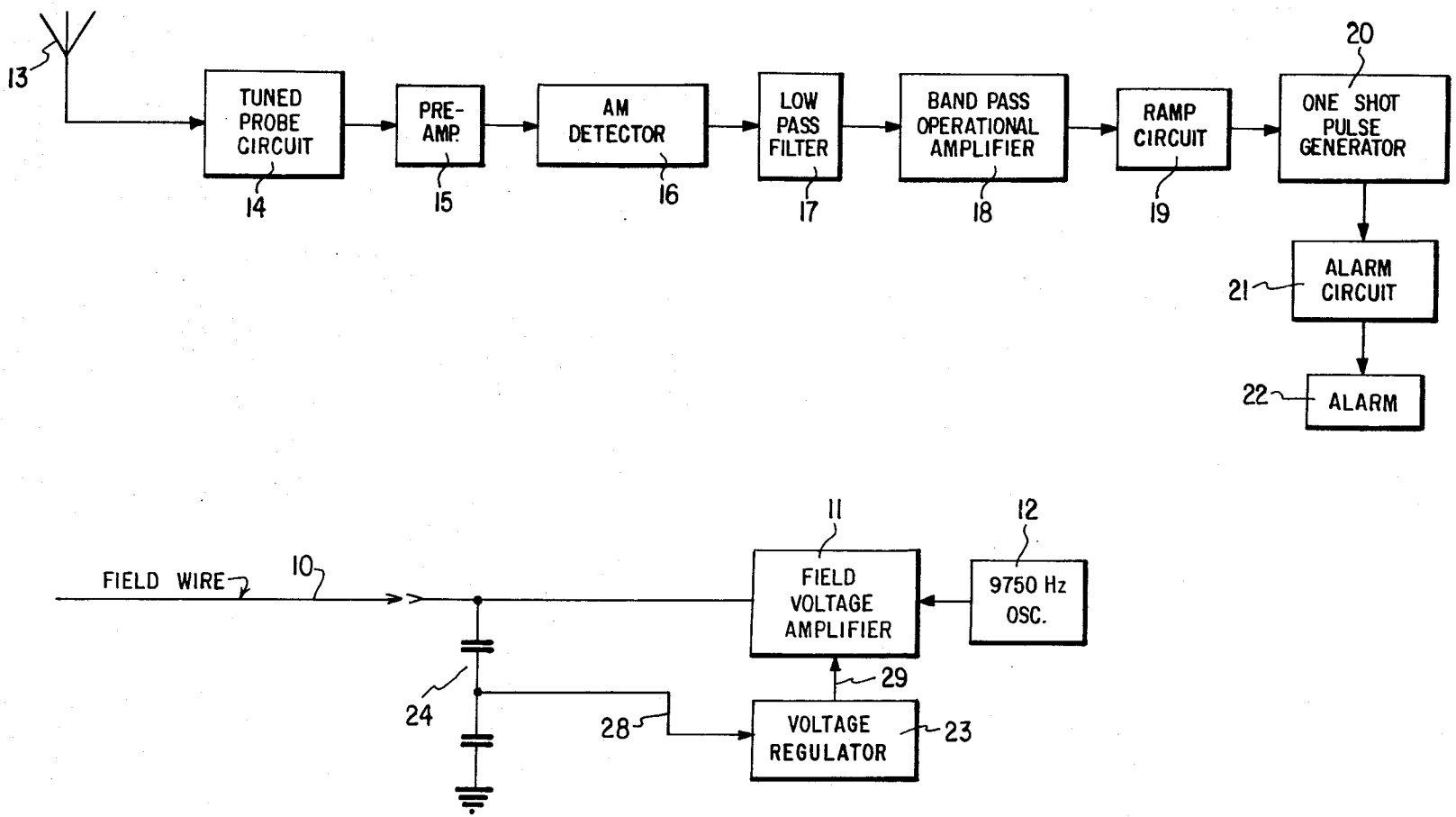
FIG. 1 is a block circuit diagram of a preferred embodiment of an intrusion warning system according to the invention.

Referring now to FIG. 1, in the intrusion warning or alarm system according to the invention, in order to produce a desired quasi-stationary electric field within an area to be protected, a transmitting antenna or field wire 10 is positioned at a desired location within an area to be protected, and is connected via an amplifier 11 to the output of a frequency controlled local oscillator 12, e.g. a crystal controlled oscillator, which produces a low frequency output signal whose wavelength is very long compared to the length of the field wire 10. The frequency of the oscillator 12 is, for example, in the range of from 1 to 40 KHz, and preferably in the range of from 2 to 20 KHz.

In order to detect or sense the electric field, a receiving antenna 13, which may for example be a length of wire or a conductive plate, is connected to an input of a tuned probe circuit 14 which includes a resonant circuit tuned to the frequency of the oscillator 12. The output of the tuned probe circuit 14 is connected to the input of an amplifier 15, which preferably provides bandpass shaping for the frequency of the oscillator 12, and contains sufficient gain to properly drive the AM detector 16 connected to the output of the amplifier 15. The AM detector 16 may, for example, be a simple diode detector or preferably, as disclosed in the above-mentioned patent application, may be a synchronous detector.

The output signal from the AM detector 16 is passed, via a lowpass filter 17 having a cutoff frequency so that it will at least filter out signals above about 20 Hz, to the input of a high gain operational amplifier 18 which is provided with a bandpass filtering arrangement so that the overall bandpass is in the order of about 0.2 to 2 Hz, which range constitutes the low frequency component associated with the motion of an intruder and is the frequency component of interest. The filtered and amplified output signal of the operational amplifier 18 is then fed via a ramp voltage generating circuit 19, which initiates the generation of a ramp voltage each time the output of the amplifier 18 changes polarity, to the input of a pulse generator 20 which produces an output pulse whenever the input signal thereto, i.e., the ramp voltage exceeds a predetermined value. The output pulse from the pulse generator 20 is, as is conventional in intrusion warning systems, fed to the alarm or indicating control circuit 21 which in turn energizes the alarm 22.

In the basic mode of operation of the system, the motion of an intruder or another object within the electric field produced by the field wire 10 will result in a modulation of the amplitude of the electric field signal received by the antenna wire 13 causing the signal at the output of the AM detector to vary, and result in the generation of an alarm.

As shown in FIG. 2, in order to provide a perimeter protection for a given area, the field wire 10 is extended along the portion of the perimeter of the area to be protected, e.g. the entire perimeter as shown, and is mounted on a plurality of fence posts 30, distributed about the perimeter, e.g. at intervals of 20 feet, by means of insulators 31 as shown in FIG. 3. The fence posts may be made, for example, of wood, steel or plastic. The field wire 10 in such an application is, for example, suspended on the posts 30 approximately five feet from the ground. The antenna wire 13 is mounted on the posts 30 in a similar manner so that it extends around the perimeter parallel to the field wire 10. For example, the antenna wire may be typically approximately one and a half feet from the ground. With such an installation, anyone approaching within approximately 1.5–2 feet of the fence formed by the field and antenna wires 10 and 13 will be detected. It should be noted that with the type of installation shown in FIG. 2 a source of false alarm problems is provided in that wind, birds or the like may cause vibration of the field and/or antenna wires 10 and 13. In order to reduce the susceptibility of the system to false alarms from this source as shown in FIG. 2, and in more detail in FIG. 4, at least one and preferably both ends of each of the wires 10 and 13 is connected to its associated fence posts 30 via an insulator 32 and a spring 33 which places the associated field or antenna wire under sufficient tension so that any vibration thereof would be at a rate which is outside of the passband of the amplifier 18. This can be accomplished, for example, by placing the wires 10 and 13, which may simply be plastic coated steel wires, under a tension of approximately 50 pounds.

As indicated above, with a field wire arrangement as shown in FIG. 2, the presence of dirt and/or moisture on the insulators 31 and 32 can cause the output voltage of the field voltage amplifier 11 to change due to changes in the effective load on the amplifier 11, which changes in voltage can result in a false alarm under certain conditions. In order to reduce the possibility of false alarms under such circumstances, according to the invention the output voltage from the field voltage amplifier is regulated so that any variation thereof is less than that required for the system to respond. As shown in FIG. 1, the regulation of the output voltage of the field voltage amplifier is preferably provided by a closed loop type of arrangement wherein the voltage regulator 23 monitors the output voltage of the field voltage amplifier 11 via a capacitive voltage divider 24 and controls the supply voltage for the output stage of the field voltage amplifier 11.

Figure 5:
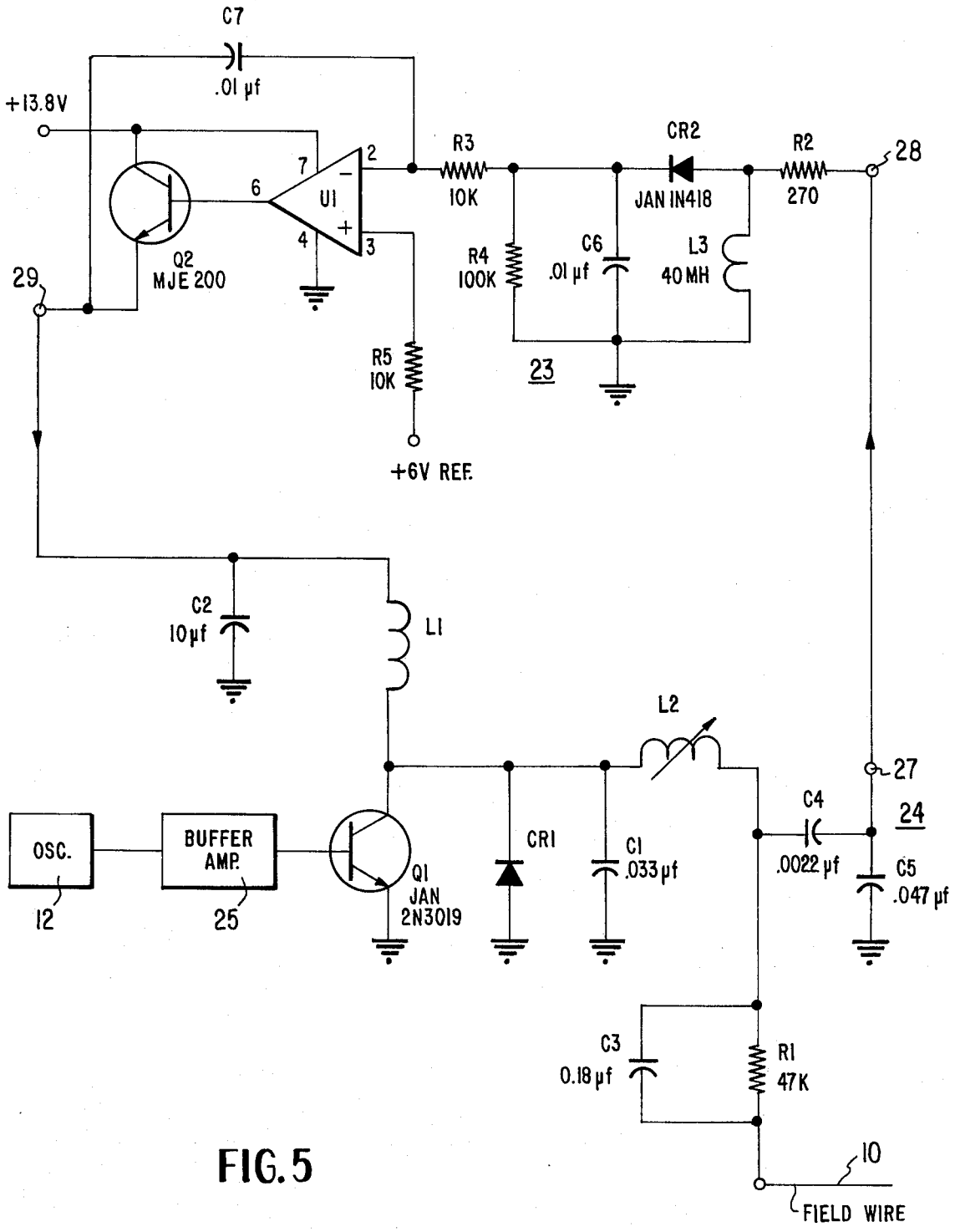
FIG. 5 is a schematic circuit diagram showing a preferred embodiment of the arrangement for regulating the field voltage applied to the field wire.

Referring now to FIG. 5, there is shown a schematic diagram for a preferred embodiment of the arrangement for regulating the output voltage of the field voltage amplifier 11. As shown, the output signal from the oscillator 12 is fed via a buffer amplifier 25, which forms a portion of the field voltage amplifier 11, to the base of a transistor Q1 which constitutes the output stage of the field voltage amplifier 11. The emitter of the transistor Q1 is connected to ground, while the supply voltage, which is nominally +6 V, is supplied to the collector of the transistor Q1 via an inductance L1. The collector of the transistor Q1, is additionally connected via an inductance L2 and a resistance R1 to the field wire 10 so as to normally produce a field output voltage of approximately 300 V peak to peak. As further shown in the drawing, the output stage of the amplifier 11 further includes a rectifier CR1 and a capacitor C1 connected in parallel with the collector emitter path of the transistor Q1, a capacitor C2 for providing filtering for the supply voltage, and a capacitor C3 connected in parallel with the resistor R1.

In order to regulate the supply voltage for the transistor Q1, the capacitor voltage divider 24, which as shown includes the series connection of capacitors C4 and C5 is connected between the junction of the inductance L2 and the resistor R1 and ground. The output 27 of the voltage divider 24 is connected to the input 28 of the regulator 23, whose output 29 is connected to the nductance L1 to provide the regulated supply voltage for the transistor Q1.

The input 28 of the regulator 23 is connected via resistance R2, a rectifier CR2 and a resistance R3 to the inverting input of an operational amplifier U1, which for example, is an LM741H operational amplifier. The input circuit for the inverting input of the operational amplifier U1 is additionally provided with an input resistor R4 and a filter including an inductance L3 and a capacitor C6. The noninverting input of the operational amplifier U1 is connected via a resistor R5 to a source of reference potential of +6 V. The output of the operational amplifier U1 is connected to the base of an NPN transistor Q2 whose emitter is connected to the output terminal 29 of the voltage regulator 23, and whose collector is connected to a supply voltage source of +13.8 V, which source also provides the supply voltage for the operational amplifier U1. Finally, a capacitor C7 is connected between the output terminal 29 and the inverting input of the operational amplifier U1.

With the arrangement shown in FIG. 5, the operational amplifier U1 compares the voltage at the output of the capacitive voltage divider 24 with the reference voltage supplied to its non-inverting input and produces an output signal which causes the transistor Q2 to be sufficiently conductive to produce the desired supply voltage at the collector of the transistor Q1 which will maintain its output voltage at the desired field voltage level. If the impedance of the field wire 10 should decrease as a result of dirt and/or moisture on the insulators connecting same to the fence posts, the loading on the output transistor Q1, and hence its output voltage, would also normally tend to decrease. This decrease in the output voltage of the amplifier Q1, however, is immediately sensed by the regulator 23 and appears as a decrease in the voltage at the inverting input of the operational amplifier U1 which causes the output voltage of the operational amplifier U1 to increase accordingly. The increased output voltage from the operational amplifier U1 in turn causes the transistor Q2 to become more conductive and increase the supply voltage for the transistor Q1 to cause same to maintain the output field voltage at the desired constant value. As a result of this regulation of the field voltage, the changes in the impedance of the field wire as seen by the output stage of the field voltage amplifier will not result in the system producing a false alarm.

It will be understood that the above description of the present invention is susceptible to various modifications, changes and adaptations, and the same are intended to be comprehended within the meaning and range of equivalents of the appended claims.

What is claimed is:

1. In an intrusion warning system for indicating the presence of an intruder into a given area comprising in combination: means for producing a quasi-stationary electric field along at least a portion of the perimeter of said area including a long field wire extending along said portion of the perimeter of said area with said field wire being mounted on and extending between a plurality of fence posts by means of respective insulators so that said field wire is insulated from ground, and first circuit means connected to said field wire for producing an output signal having a wavelength which is very long compared to the length of said field wire and a frequency which is in the range of from 1–40 KHz, said field circuit means including an oscillator circuit for producing an output signal having said frequency in the range of from 1–40 KHz, a first amplifier having an input connected to receive the output signal of said oscillator circuit and an output connected to said field wire, and voltage regulating means, having an output connected to said first amplifier, for regulating the output voltage from said first amplifier; a receiving antenna within said area for receiving said electric field; a second amplifier having an input connected to said antenna; AM detector means, responsive to an output signal from said second amplifier, for detecting changes in the received and amplified electric field signals and for producing an output signal corresponding to same; second circuit means, including voltage amplifying means and filter means, for amplifying said output signal from said detector means and for passing only any low frequency component of said output signal from said detector which is in the range from approximately 0.2 to 2 Hz due to a disturbance of said electric field caused by movement of an intruder; threshold circuit means, responsive to an output signal from said second circuit means, for producing an output signal whenever said output signal from said second circuit means exceeds a predetermined threshold value; and means, responsive to said output signal from said threshold circuit means, for providing an alarm indicating the disturbance of said electric field by an intruder; the improvement wherein: said first amplifier has an output stage including a transistor having an emitter connected to ground, a base connected to receive the output signal from said oscillator circuit and a collector connected to said output of said regulating means via an impedance, and to said field wire; and said regulating means comprises means responsive to said output voltage from said first amplifier for providing a controlled supply voltage to said output stage of said first amplifier including: a capacitive voltage divider connected between the output of said first amplifier and ground; an operational amplifier having an inverting input connected to an output of said capacitive voltage divider, a non-inverting input connected to a source of reference potential, and an output; and means for connecting said output of said operational amplifier to said output of said regulating means.

2. An intrusion warning system as defined in claim 1 wherein said voltage regulating means regulates said output voltage from said first amplifier sufficiently to prevent changes in said output voltage, due to transient changes in the impedance of said field wire as seen by said first amplifier, which are of sufficient magnitude to cause said threshold circuit to respond.

3. An intrusion warning system as defined in claim 1 wherein said receiving antenna comprises a length of wire mounted on said fence posts by means of insulators and extending substantially parallel and coextensive with said field wire.

4. An intrusion warning system as defined in claim 3 wherein said field wire and said antenna wire extend substantially around the entire perimeter of the area to be protected.

5. An intrusion warning system as defined in claim 1 wherein said means for connecting said output of said operational amplifier comprises an NPN transistor having a base connected to the output of said operational amplifier, a collector connected to a source of operating potential and an emitter connected to said output of said regulating means.

6. An intrusion warning system as defined in claim 5 wherein said regulating means further includes a capacitor connected between said emitter of said NPN transistor and said inverting input of said operational amplifier.

7. An intrusion warning system as defined in claim 1 wherein said regulating means further includes a rectifier connected between said output of said capacitive voltage divider and said inverting input of said operational amplifier.

* * * * *